United States Patent [19]

Rudy et al.

[11] 4,255,294

[45] Mar. 10, 1981

[54] FABRIC SOFTENING COMPOSITION

[75] Inventors: Jerome Rudy, Livingston; Frederick Lazzara, Teaneck, both of N.J.; Warren W. Cowles, Pittsford; Arno Cahn, Pearl River, both of N.Y.

[73] Assignee: Lever Brothers, New York, N.Y.

[21] Appl. No.: 563,963

[22] Filed: Apr. 1, 1975

Related U.S. Application Data

[63] Continuation of Ser. No. 94,577, Jun. 14, 1971, abandoned, which is a continuation of Ser. No. 743,325, Jul. 9, 1968, abandoned, which is a continuation-in-part of Ser. No. 551,956, May 23, 1966, abandoned.

[51] Int. Cl.[3] ..... C11D 1/86; C11D 3/30; C11D 3/28

[52] U.S. Cl. ..... 252/524; 252/8.6; 252/8.75; 252/8.8; 252/528; 252/529; 252/542; 252/547; 252/548

[58] Field of Search ..... 252/541, 8.8, 528, 547, 252/8.75, 8.6, 524, 542, 106, 529, 548; 8/137

[56] References Cited

U.S. PATENT DOCUMENTS

| | | | |
|---|---|---|---|
| 2,577,773 | 12/1951 | Lambert | 252/8.8 |
| 2,734,830 | 2/1956 | Hagge et al. | 252/8.8 |
| 3,095,323 | 6/1963 | Blomfield | 252/8.8 |
| 3,325,404 | 6/1967 | Cohen et al. | 252/8.75 |
| 3,325,414 | 6/1967 | Inamovato | 252/528 |
| 3,330,770 | 7/1967 | Van Loo et al. | 252/542 |
| 3,360,470 | 12/1967 | Wixon | 252/99 |
| 3,364,142 | 1/1968 | Buck | 252/547 |
| 3,454,494 | 7/1969 | Clark et al. | 252/8.8 |

*Primary Examiner*—Harris A. Pitlick
*Attorney, Agent, or Firm*—Brumbaugh, Graves, Donohue & Raymond

[57] ABSTRACT

This application discloses a novel fabric softening composition which is a dispersed complex of a cationic nitrogenous compound and an anionic detergent, the complex containing two or more alkyl radicals having from 15 to 24 carbon atoms, the dispersing agent used being an ethylene oxide condensate of a hydrophobic organic radical having from 50% to 80% ethylene oxide.

4 Claims, No Drawings

FABRIC SOFTENING COMPOSITION

This is a continuation of our copending application Ser. No. 94,577 of June 14, 1971 (now abandoned) which was a continuation of application Ser. No. 743,325 of July 9, 1968 (now abandoned), which, in turn, was a continuation-in-part of application Ser. No. 551,956 of May 23, 1966 (now abandoned).

This invention relates to a novel fabric softening formulation having utility as a fabric softener in the presence of the common synthetic organic detergent compositions. A further aspect of this invention is concerned with a multi-functional laundry composition containing both a synthetic anionic organic detergent and an effective fabric softening additive.

It has long been sought in the art to provide fabric softeners which are effective in the presence of the ordinary organic anionic synthetic detergents. Such a fabric softener formulation would be of particular value to enable housewives to employ fabric softeners simultaneously with the detergent during the wash cycle, that is, simultaneously to wash and to soften clothing, in contrast with the now common procedure of successively washing clothing in the presence of a detergent composition followed by rinsing the clothing in the presence of a fabric softening composition. The latter procedure has the disadvantage that many of the home washing machines now in use are so designed that in order to employ rinsecycle fabric softeners, it is necessary for the housewife to watch the cycle timing carefully and to interrupt the cycle as it enters the rinsing step to add a fabric softener.

Despite the obvious advantages of employing fabric softeners concurrently with the detergent during the washing step, it has heretofore proved difficult to do so. As is well known, the most common commercial fabric softeners are cationic substances such as the quaternary ammonium compounds. Distearyl dimethyl ammonium chloride, for example, is illustrative of a well-known fabric softening agent which is widely used in the detergent industry when formulating fabric softeners. The quaternary or cationic fabric softeners, however, are normally recognized as being incompatible with the anionic synthetic detergents, for example, alkylbenzene sulfonates, which are widely used in many laundry detergent formulations. When a cationic fabric softener and an anionic detergent are simultaneously present in the same washing solution, the well-known cationic-anionic interaction occurs. The resultant complex which thereby forms had been thought to be deleterious, especially in the formulation of multi-functional detergent compositions. Typically the formation of the complex is manifested by a substantial loss in the ability of the detergent to suds and by the formation of a greasy precipitate or coacervate. As the result of the formation of this complex, the fabric is softened unevenly and may even have a noticeably spotted appearance.

Some investigators have attempted to overcome the foregoing difficulties, when preparing fabric softeners for use in conjunction with detergents, by employing only certain types of fabric softening agents, or by employing certain types of dispersants. Still other proposals have been directed to the manufacture of multi-functional detergent components based on a nonionic detergent active, which tends to avoid the difficulties normally encountered when a cationic fabric softener and an anionic detergent are used concurrently. However, these proposals have not been free of further difficulties. For example, severe cloth yellowing occurs when nonionic detergents and fabric softeners are combined.

Still further, it is known that even when fabric softeners are employed in a separate cycle from the wash cycle, i.e., the conventional softening method wherein a rinse-cycle softener is employed, many softeners tend to cause a substantial yellowing of the fabric being treated. Unfortunately, the yellowing is most pronounced when employing those fabric softeners which are generally considered to be the most effective, for instance, softeners such as distearyl dimethyl ammonium chloride. While a number of softeners of other types have been proposed which have a lesser tendency to cause yellowing, these other types of fabric softeners are noticeably less effective as softeners.

The fabric softening compositions of the present invention overcome all of these disadvantages. Not only is it found that the cationic fabric softening compound may be used concurrently with an anionic surface-active agent without loss of uniform softening power, or the occurrence of objectionable precipitates, but, most surprisingly, it has been found that the fabric softening formulations of the present invention, when used in connection with a nonionic-base detergent composition, are free of the cloth-yellowing problem which has heretofore been encountered in ordinary fabric softeners.

In accordance with one aspect of the present invention, it has now been discovered that if cationic fabric softeners and anionic detergents are dry-blended, the cationic-anionic complex which forms on adding the blend to water can be dispersed with a small amount of an ethylene oxide condensate, and when so dispersed provide fabric softening properties. The softening properties of the dispersed complex are not affected by anionic detergents, and are, moreover, observed even on synthetic fabrics such as polyesters and nylon.

More specifically, in accordance with the present invention, there is provided a fabric softening composition which consists essentially of a cationic nitrogenous compound having 15 to 65 carbon atoms in its molecule, and having at least one cationic nitrogen atom which is associated with members selected from the group consisting of hydrogen, hydrocarbon and substituted hydrocarbon radicals, the substituent groups in said substituted hydrocarbon radicals being selected from the group consisting of oxy, hydroxy, amido, amino, carbonyl and carboxylic groups, an anionic organic detergent compound characterized by a hydrocarbon group of from 8 to 22 carbon atoms and a sulfate or sulfonate salt of a water-solubilizing cation, the ratio between the anionic detergent and cationic compound being between about 0.5/1 and 12/1 (molar ratios) said cationic compound and the anionic detergent when combined in a 1:1 mole ratio further containing a total of at least 29 carbon atoms and containing at least 2 long chain alkyl groups of between about 12 and 24 carbon atoms. To complete the fabric softening composition the cationic compound and anionic compounds are further combined with from 9 to 20 parts, per 100 parts of the cationic nitrogenous compound, of a dispersant which is a nonionic condensate of ethylene oxide, containing from 50% to 80% by weight ethylene oxide. The final composition should contain less than about 10% of the nonionic dispersant, and preferably less than 5% of the nonionic, based on the combined weights of the cationic and anionic compounds. The foregoing fabric softener composition is of general utility as a wash cycle softener, that is, as a material which may be used in the wash cycle of a washing machine in which conventional detergent products are used, especially those containing typical anionic surfactants.

As a preferred embodiment of this invention, the fabric softener formulation just described will be employed as a portion of a multi-functional powdered laundry detergent formulation in which a sufficient amount of the organic anionic detergent is present to impart detergent properties to the complete formulation. For this purpose a ratio of anionic to cationic compounds should be at least about 1.2:1 on a molar basis. In an alternative preferred embodiment, the present invention may be embodied in a fabric softening formulation intended for use as a wash-cycle softener in which the housewife uses a detergent of her choice. As a wash-cycle softener, the compositions of the present invention will contain from 0.5 to 1.2 parts of detergent per part of softener on a molar basis.

An important aspect of the present invention is the discovery of a fabric softener which can be employed in conjunction with anionic detergents. When used in combination with anionic detergents in accordance with the present invention, it has been found that many of the disadvantages of the conventional cationic fabric softeners are overcome. As already mentioned, a disadvantage of the conventional fabric softening formulations based upon cationic detergents is the formation of a cationic-anionic complex, giving rise to non-uniform softeners and a heavy, grease-like phase which seriously spots the clothing being washed. This complex may also plug the passages of the soap dispensing devices of the automatic machines, thereby preventing the detergent from being discharged into the washing bath.

It is believed, although the invention is not to be limited to this theory, that the fabric softening is achieved in the use of materials of the present invention as a result of the formation of a cationic-anionic complex which itself has fabric softening properties. By providing for an appropriate nonionic dispersant, it is possible to prevent the cationic-anionic complex from agglomerating and causing the untoward effects which were well known to those skilled in the art. The formation of the above-mentioned complex is believed to consume the cationic compound and anionic detergent in a 1:1 mole ratio (assuming that both are monovalent). In the typical case this will correspond to a weight ratio of anionic detergent/cationic compound of about 0.6/1. Excess anionic detergent above this amount assures the complete conversion of the cationic compound to the complex. However, if the amount of excess anionic detergent is too great, the complex will be overly dispersed and will not be effective to soften. Hence, the molar ratio of anionic detergent to cationic should not exceed about 12/1. Where only fabric softening is desired, the stoichiometric minimum, or even slightly less anionic compound, may be present.

By providing for a sufficient ratio of anionic to cationic compounds, it is possible to obtain a resulting mixture which, even after a portion of the anionic compound reacts with the cationic compound to form the above-mentioned complex, will retain a detergency power which is sufficient for home laundry purposes.

The cationic nitrogenous compounds which may be used in the practice of the present invention have already been generally described above. The preferred class of compounds includes the well-known cationic fabric softening agents, which had heretofore been thought to be ineffective in the presence of anionic detergents. Typically, the cationic compounds useful in the present invention have a cationic nitrogen atom in the molecular structure and will normally contain one or more aliphatic, linear hydrocarbon groups of 12 to 24 carbon atoms. Alicyclic groups may also be used, although these are not typically found in commerce. A suitable alicyclic hydrocarbon group may be derived from rosin or abietic acids.

The most common commercially available cationic fabric softening compounds are typically characterized by one to three aliphatic, linear hydrocarbon groups of 16 to 20 carbon atoms. The commercial cationic fabric softening compounds are a relatively small class of materials which can be exemplified by the following:

(a) The reaction products of higher fatty acids with hydroxyalkyl alkylene diamines in a molecular ratio of about 2:1. The structure of this composition is sometimes given as

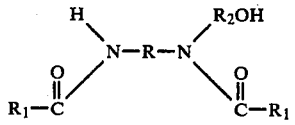

wherein R is a $C_1$–$C_3$ alkylene radical, $R_1$ is a $C_{15}$–$C_{19}$ acyclic, aliphatic hydrocarbon radical and $R_2$ is a divalent $C_1$–$C_3$ alkylene radical. However, it is known that the foregoing formula is not completely descriptive of the reaction product. Many other chemical entities are known to occur as a result of the reaction.

(b) Quaternary ammonium compounds having the formula

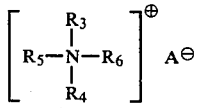

wherein $R_3$ is a $C_{16}$–$C_{20}$ acyclic, aliphatic hydrocarbon group, $R_4$ and $R_5$ are selected from the group consisting of $R_3$ and $C_1$–$C_3$ alkyl groups, $R_6$ is a $C_1$–$C_3$ alkyl group or a benzyl group, and A is an anion imparting water dispersability. Distearyl dimethyl ammonium chloride is representative, and is one of the most widely used fabric softeners.

(c) $C_{16}$–$C_{20}$ amide imidazoline salts, wherein the $C_{16}$–$C_{20}$ group is an acyclic aliphatic hydrocarbon radical.

(d) Alkanamide alkylene pyridinium chloride having the formula

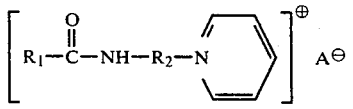

(e) 1-(2-alkylamido ethyl)-2-alkyl imidazoline salts having the formula

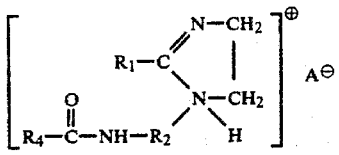

(f) The salts of heptadecyl imidazoline having the formula

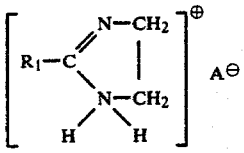

Of the foregoing compounds the quaternary ammonium compounds of the general formula

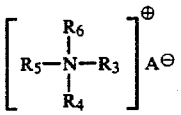

are significantly more effective than the remaining compounds mentioned, and, for this reason, they are preferred. Distearyl dimethyl ammonium chloride and octadecyl dimethyl benzyl ammonium chloride are representative of this class of softeners. In commercial practice, fabric softening compounds will normally contain one or more $C_{17}$ or $C_{18}$ groups, i.e., octadecyl stearyl, oleoyl, and the like.

In addition to the conventional fabric softening compounds, other cationic compounds useful in the present invention include a number of cationic nitrogenous compounds not normally considered as exhibiting fabric softening properties in their own right.

Representative classes of compounds which are contemplated include quaternary benzyl amines of the formula

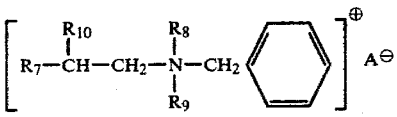

where $R_7$=an alkyl group having 7 to 12 carbon atoms, $R_8$ and $R_9$ are independent alkyl groups of 1 to 3 carbon atoms or hydroxyalkyl groups of 2 to 3 carbon atoms, $R_{10}$ is hydrogen or a hydroxyl group and A is an anion;

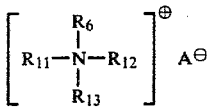

where $R_8$ and A are as defined above; $R_{11}$ is an alkyl group having 12 to 14 carbon atoms; $R_{12}$ is selected from the group consisting of $R_8$ and $R_{11}$; and $R_{13}$ is selected from the group consisting of $R_8$ and benzyl;

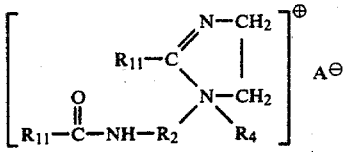

where $R_2$ is a divalent alkylene group having one to three carbon atoms; $R_4$ is an alkyl group having 1 to 3 carbon atoms; and $R_{11}$ and A are as defined above;

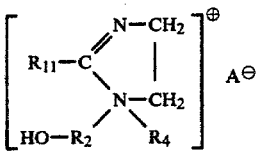

wherein $R_2$, $R_4$, $R_{11}$ and A are as defined above; and

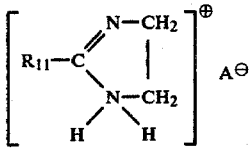

where $R_{11}$ is as defined above.

Compounds illustrative of the foregoing include the dodecyl trimethyl ammonium halides, di(dodecyl)dimethylammonium halides, N-methyl-N-(2-hydroxyethyl)-N-(2-hydroxydodecyl)-N-benzyl ammonium halides, 2-undecyl-1-methyl-1[(2-lauroyl amido)ethyl]-imidazolinium methosulfate, 2-undecyl-1-ethyl-1(2-hydroxypropyl)imidazolinium ethosulfate, and the acetate salt of 2-tridecyl imidazoline.

It will be obvious that the anion which is associated with the cationic nitrogenous compound is not of importance. A wide variety of anions are commonly employed, among them being the halides, especially chlorides, bromides and iodides, sulfates and alkyl sulfates.

The nonionic condensates contemplated for use in the present invention are the polyoxyethylene ethers of hydrophobic organic compounds having a reactive hydrogen and an alkyl group of 8 to 22 carbon atoms. In the normal case, the hydrophobic organic moiety will be a hydrocarbon or a substituted hydrocarbon having one or more ether, acyl or hydroxy groups. The ether should contain from 50% to 80% ethylene oxide by weight, and will typically have a molecular weight between about 300 and about 5000. Suitable nonionic dispersants are of course well known in the art. By way of illustration, but not limitation, typical compounds which are contemplated can be represented by the formula $$Z—(OC_2H_4)_nOH$$

where Z is a moiety containing a hydrophobic group and n is a number sufficient to yield a condensate containing 50% to 80% ethylene oxide. The radical Z may be a $C_{12}$ to $C_{22}$ alkyl, a $C_{14}$ to $C_{18}$ monocyclic alkylaryl, a $C_{12}$ to $C_{22}$ acyl, a residue of an ester of a polyhydroxy compound and an alkanoic acid, the polyhydroxy moiety having from 3 to 6 carbon atoms and 2 to 5 OH groups, and the acyl moiety having 12 to 18 carbon atoms, or a polyoxypropylene group having a molecular weight of 800 to 2500. Specific examples of the foregoing include Alcohol-ethylene oxide condensates $C_{12}H_{25}O(C_2H_4O)_9H$
$C_{22}H_{45}O(C_2H_4O)_{18}H$
(OXC) $C_{13}H_{27}O(C_2H_4O)_{10}H$
Mixture of $C_{14}$, $C_{16}$, and $C_{18}$ primary aliphatic alcohols condensed with ethylene oxide in an amount to provide about 60% weight basis on condensate.

Alkyl phenol-ethylene oxide condensates iso-$C_6H_{17}$-$C_6H_4O(C_2H_4O)_6H$
iso-$C_8H_{17}$-$C_6H_4O(C_2H_40)_{30}H$
n-$C_{12}H_{25}$-$C_6H_4O(C_2H_4O)_{15}H$ Fatty acid-ethylene oxide condensates $C_{18}H_{35}COO(C_2H_4O)_{10}H$ Polyhydric alcohol-ethylene oxide condensates Sorbitol mono-oleate 0.15 E.O.
Sorbitan monolaurate 0.20 E.O.

Propylene oxide-ethylene oxide condensates (1) $HO(C_2H_4O)^a(C_3H_6O)^b(C_2H_4O)^cH$, wherein b provides a base poly-oxypropylene of m.w. 800–1000, and a+c provides about 60% oxyethylene units by weight of condensate.
(2) $HO(C_2H_4O)^a(C_3H_6O)^bHNCH_2CH_2NH(C_3H_6O)^c(C_2H_4O)^dH$, wherein b+c provides a hydrophobic base having a molecular weight of about 1500 and a+d provides about 80% oxyethylene units by weight of the condensate. U.S. Pat. No. 2,979,528 to Lundsted (Wyandotte).

The preferred nonionic dispersants of the present invention are ethylene oxide condensates of the alkyl alcohols, but containing between about 12 and about 22 carbon atoms in the alcohol portion of the condensate, and containing between about 60% and 75% ethylene oxide. Appropriate materials may be obtained, for example, from natural sources, for instance, ethoxylated tallow alcohols. More recently, there have become commercially available a number of synthetically derived ethoxylated alcohols wherein the alcohol is derived by the Ziegler polymerization of ethylene or by means of the well-known Oxo reaction. Biodegradable dispersants are preferred, and, as well known, these are generally characterized by linear alkyl groups such as would be obtained by the use of alcohols derived from naturally occurring fats and oils, or by the use of alcohols derived by the Ziegler polymerization of ethylene.

In addition to the ingredients just described, the fabric softening composition of the present invention may contain other materials. For example, it has been found that the addition of up to 160 parts (per 100 parts of cationic compound) of certain inert solids significantly improves the fabric softening effectiveness thereof. This unexpected result may be obtained by adding materials such as talc, or finely-divided powders of polyethylene, polypropylene, poly(tetrafluoroethylene), polyethylene glycols having a molecular weight of 20,000 or more, calcium stearate and magnesium stearate. In view of the unexpected improvement obtained by providing for the presence of such materials in the fabric softening composition the preferred materials of the present invention will contain them in addition to the principal anionic detergent compound, cationic compound and the nonionic dispersant. The amounts of the extraneous materials are not important; however, it is preferred to employ them in a ratio of about 6 to 24 parts by weight for each 100 parts of fabric softener.

The fabric softening compositions of the present invention are preferably employed as powders. The powder may be prepared from the ingredients by any convenient processing method. Techniques for preparing such powders are well known to those skilled in the art and include methods such as dissolving or dispersing the ingredients concurrently in an appropriate solvent and drying the resultant solution or slurry, or spraying one of the ingredients onto a powder prepared from the other.

It has been found particularly effective, however, and it is preferred for ease of processing in the present invention, to prepare the powdered fabric softening composition by co-melting the cationic compound and the nonionic dispersant. The optional ingredients, such as talc and inorganic salts, which are normally not fusible, may be added to and dispersed in the melt which is composed of nonionic dispersants and cationic fabric softening compounds. After solidifying, the melt is then comminuted to a powder having an appropriate degree of fineness to blend compatibly with the anionic detergent.

The anionic detergent compounds with which the fabric softening composition of the present invention can be used may be any anionic synthetic detergent compound of the type well known to those skilled in the art. The commercially most common type of synthetic detergents are the sulfate and sulfonate detergent salts of organic compounds having in their molecular structure an aliphatic hydrocarbon group having from about 8 to about 22 carbon atoms with a water solubilizing cation. In view of the contemporary concern over pollution of ground waters, it will be recognized that biodegradable detergents are preferred and may be commercial necessities in some areas. Typical compounds which may be mentioned as appropriate anionic synthetic organic detergent compounds include, but are not limited to, alkali metal dodecyl benzene sulfonate, alkali metal pentadecyl benzene sulfonate, alkali metal hexadecyl benzene sulfonate, and alkali metal $C_{12}$–$C_{16}$ alkyl benzene sulfonate, containing either a linear (biodegradable) alkyl group or a branched-chain group, alkali metal tallow alcohol sulfate, ammonium dodecyl benzene sulfonate, the alkali metal salts of N-(2-hydroxyalkyl)-N-methyl-taurine derived from 1,2-epoxydodecane, the triethanolamine salt of N-(2-hydroxyalkyl)-N-methyl-taurine containing $C_{11}$–$C_{15}$ alkyl groups, magnesium alkyl benzene sulfonate, alkali metal tallow-N-methyl taurate and alkali metal acyl coco isethionate. Also included are the dianionic sulfates and sulfonates, that is, compounds having two such functional groups in each molecule. Among these may be mentioned:

tetradecane-1,2-disulfonate
octadecane-1,2-disulfate
$C_{15}$–$C_{20}$ alkyl-1,8-disulfate
(hexadecyloxy)propane-1-sulfonate-2-sulfate For both the dianionics and the mono-anionics the salt-forming cations may be any of the alkali or alkaline earth metals, ammonium or substituted ammonium, which form water-soluble or water-dispersible compounds. Usually the cation will be sodium when the compositions of the invention are made in solid or particulate form, and will usually be potassium, sodium, ammonium, or substituted ammonium when made in liquid form. Typical substituted ammonium cations are mono-, di-, and triethanol-ammonium, morpholinium, isopropanolammonium, pyridinium, etc.

A more detailed list of detergents, within the scope of the invention is set forth in Table I. Table I indicates the molecular substituent to which the hydrocarbon group is attached. The hydrocarbon group is defined as a straight or branched chain alkyl or a straight or branched chain alkyl-aryl group. The table also shows the range of carbon atoms in the hydrocarbon group and in the entire detergent molecule.

The term "hydrocarbon" includes hydrocarbon groups having a hydroxy substituent.

TABLE I

| Anionic Detergent | Hydrocarbon Group Bonded to | Approximate No. of Carbon Atoms in Hydrocarbon Group | Approximate No. of Carbon Atoms in Entire Molecule |
|---|---|---|---|
| Alkyl aryl sulfonate | sulfonate | 17–21 | 17–21 |
| Alkyl sulfate (from coco or tallow) | sulfate | 6–18 | 6–18 |
| Alkanesulfonate | sulfonate | 12–22 | 12–22 |
| Alkenesulfonate | sulfonate | 12–22 | 12–22 |
| Acyl taurate | amido | 5–17 | 8–20 |
| Acyl isethionate | carboxy | 5–17 | 8–20 |
| Alkyl phenoxy polyoxyalkylene sulfate | sulfate | 14–18 | 20–42 |
| Alkyloxy polyoxyalkylene sulfate | ether | 12–18 | 18–48 |
| Alkoxyhydroxypropane-sulfonate | ether | 12–18 | 15–21 |
| Hydroxyalkanesulfonate | sulfonate | 12–22 | 12–22 |
| Alkanedisulfonate | sulfonate | 12–22 | 12–22 |
| Alkyl disulfate | sulfate | 12–22 | 12–22 |
| Alpha-sulfoalkanoate | sulfonate | 11–19 | 12–20 |
| Hydroxyalkyl-N-methyl taurine | amino | 8–22 | 10–24 |

Mixtures of two or more of the foregoing may be employed if desired.

As already mentioned, an unexpected discovery is that the cloth-yellowing problem which has been widely encountered with the commercially available fabric softener formulations heretofore is substantially avoided when the fabric softening composition of the present invention is used in combination with a detergent formulation containing a synthetic anionic detergent as a characteristic active ingredient. Since fabric yellowing has been a long-standing problem in the use of fabric softeners, especially the commercially more economical, and technically more effective materials, such as distearyl dimethyl ammonium chloride, the discovery that a cationic fabric softening compound (or other cationic nitrogenous compound) may be employed in the form of a complex with an anionic detergent compound, and the yellowing problem thereby be avoided, is most unexpected and of obvious benefit.

The best results from employing the fabric softening compositions of the present invention are obtained when they are used in the proper proportions with the anionic detergent compound. Accordingly, it is obviously preferred, and to the benefit of the consumer, that the fabric softening composition of this invention should be prepared with an anionic detergent compound especially adapted to bring out the best properties thereof, and in proportions which are adapted to yield the optimum results. It is for these reasons that it is the preferred embodiment of the present invention to provide a multi-functional detergent composition which contains sufficient anionic detergent compound in addition to that required to form a complex to impart detersive properties to the complete formulation.

When preparing multi-functional detergent compositions, the anionic detergent compound and cationic fabric softening compound should be present in a ratio of at least about 1.2:1 on a mole basis to assure sufficient stoichiometric excess of the anionic detergent compound. Preferably the ratio of anionic detergent compound to cationic fabric softening compound does not exceed about 5 to 1 (by weight). This ratio provides an optimum balance of fabric softening power to detergency power. If, on the one hand, the amount of anionic compound relative to the amount of cationic is too small, the formation of the cationic-anionic complex will seriously deplete the amount of free anionic compound, thereby impairing the detergency power of the blend. On the other hand, if the amount of anionic compound is excessive relative to the amount of cationic, the fabric softening cationic-anionic complex will be overly dispersed, thereby preventing its adherence to the fabric during the washing process. A ratio of cationic fabric softening compound to anionic detergent compound within the above-mentioned limits has been found, surprisingly, to provide a balance of properties whereby fabric softening is obtained in the presence of an anionic detergent and, at the same time, the detergency effectiveness of the basic detergent powder is not significantly impaired.

As is well known, many synthetic anionic compounds require the presence of an alkaline builder to provide optimum detergency effectiveness. Accordingly, the multi-functional detergent formulation contemplated by the present invention, may contain a builder. Many inorganic alkaline builders are well known to those skilled in the art. These include compounds such as trisodium phosphate, trisodium nitrilotriacetate, potassium pyrophosphate, sodium pyrophosphate, potassium or sodium tripolyphosphate, and potassium or sodium hexametaphosphate. Still other builders which have, on occasion, been proposed include the alkaline carbonates, i.e., sodium or potassium carbonate. It is also known that certain amides and alkyloamides may be employed, either alone or in combination with phosphate builders, for the purpose of improving the detergency effectiveness of alkylbenzene sulfonate.

The builders just described will be used in those proportions, which are well known to those skilled in the art, sufficient to improve the detergency of the organic, anionic detergent compound. For instance, when using builders such as the alkali metal pyrophosphates and polyphosphates, which are the commercially most popular builders, the amount of builder will be in the order of from about one-half to about five parts of builder for each part by weight of synthetic organic detergent. Light duty detergents normally will be formulated with lower amounts of alkaline phosphate builders, or, more commonly, using alkyl amide or alkyloamide organic builders in lieu of the relatively caustic inorganic builders.

The multi-functional detergent compositions of the present invention may, moreover, be formulated with many other components which are well known to those skilled in the art, to improve the various properties of detergent formulations. These optional ingredients, which in most cases will normally be present, include materials such as the cellulosic soil anti-redeposition agents (of which sodium carboxymethyl cellulose, hydroxyethyl cellulose, and sodium carboxymethylhydroxyethyl cellulose are the commercially most common materials), alkali toluene sulfonates, xylene sulfonates and cumene sulfonates which are employed as processing aids, alkali silicates which are useful as corrosion retardants, fluorescent dyes, colorants, perfumes, germicides, and inert salts such as sodium chloride or sodium sulfate which frequently accompany the detergent-active ingredients as by-product salts resulting from the manufacturing process. Any and all of the foregoing materials may be included, if desired, in effective amounts well known to those skilled in the art.

In the foregoing discussion of detergent-active ingredients, inorganic alkaline builders and miscellaneous ingredients, reference has been made generally to the alkali metal salts. Those skilled in the art recognize that the entire group of alkali metals are thought to be generally appropriate; however, because of their greater availability, only the sodium and potassium salts are normally found in commerce. In lieu of the alkali metal salts, a number of ammonium and substituted ammonium salts are known, especially as applied to the principal detergent active ingredients. The ammonium, triethanol amine and morpholinium salts are illustrative water-solubilizing cations which may be associated with detergent-active compounds.

In the preferred embodiment of this invention, it is contemplated that a multi-functional detergent material will be prepared by dry blending a fabric softening phase containing the cationic compound and nonionic dispersant in powdered form with a powdered detergent which contains the synthetic organic anionic detergent compound. By pre-blending the ingredients, the proper proportions of fabric softening compound and anionic detergent compound are assured. Moreover, combinations of the cationic fabric softeners and anionic detergents in accordance with the preferred embodiments yield results not obtainable by the use of fabric softeners with other detergent actives. Water-repellancy, a characteristic frequently found on fabrics subject to repeated application of softeners, is materially reduced.

In a multi-functional detergent composition as described above, the fabric softener phase may contain the additional materials mentioned above for improving the fabric softening ability of the composition, these being materials selected from the group consisting of talc, finely-divided powders of polyethylene, polypropylene, poly(tetrafluoroethylene), high molecular weight polyethylene glycols, calcium stearate and magnesium stearate. The explanation for their surprising synergistic effectiveness in combination with cationic fabric softening ingredients is not understood.

Still further, either the detergent or fabric softening phases may contain colorants, optical brightening ingredients, dyes and the like. In connection therewith, it has been found that a product of greater consumer attractiveness is obtained if the detergent is provided with a speckled appearance, that is, particles of differing colors which suggest visually the multifunctional characteristics provided. For example, it may be convenient, in the preparation of detergent formulations in accordance with the present invention, to provide a red colorant in the fabric softening composition (giving the latter a pinkish hue) and to provide a blue colorant in the detergent composition. The speckled appearance need not be achieved in this manner, however. It may, for example, be achieved by dividing only the detergent powder into two or more portions, each of which is provided with a different color.

While reference has been made in the foregoing specifically to multi-functional detergent compositions composed of two powdered phases, one containing a cationic fabric softening composition and the other containing an anionic detergent compond, it will be obvious to those skilled in the art that the present invention is not limited to the preparation of the two-phase systems specifically described. For example, in one embodiment, it may be convenient to prepare a detergent composition composed of one phase containing a synthetic anionic detergent and a second phase containing an alkylolamide suds booster. Obviously, dry blending such a composition with the fabric softening composition described above is within the scope of the present invention. Also contemplated are multi-functional detergents prepared as single-phase mixtures.

When formulated as a single phase, more or less monogeneous powder, the cationic and anionic ingredients interact with each other during processing and tend to form tacky compositions which cannot always be easily processed unless a high level of phosphates or other inorganic materials are present. This problem is particularly troublesome when using the highly branched alkyl benzene sulfonates. The combinations of cationic softener, anionic detergent and nonionic dispersant of the present invention can be so formulated under suitable conditions. In some instances, this difficulty can be mitigated or overcome through a judicious selection of surfactants. In cases where this cannot be done, multi-functional detergent compositions may be prepared in which the fabric softening ingredients and the detergent ingredients are in separate powdered phases. In most instances, two-phase compositions of widely varying formulas can be satisfactorily processed, and it is for this reason that multi-phase formulations are preferred.

Among the materials giving difficulty in preparing single-phase compositions is the nonionic dispersant used to disperse the cationic-anionic complex which tends to accentuate the inherent tackiness of the anionic-cationic complex in single-phase formulations. This ingredient plays an important role in providing uniform and effective softening when formulating dry blends of cationic softeners and anionic dispersants. However, in accordance with another aspect of this invention it has been found that when single-phase mixtures of anionic and cationic are prepared the nonionic dispersant may be omitted. It has been found in this case that the cationic compound, which is actually present in the single-phase mixture substantially in complexed form, may be adequately dispersed by the anionic detergent through careful selection of proportions. Single-phase mixes in which the nonionic ingredient is omitted generally have the following approximate composition:

| | |
|---|---|
| Anionic detergent | 8.0%–10.5% by weight |
| Inorganic alkaline builders | 55.0%–65.0% by weight |
| Soil suspending and anti-redeposition agents | 0.5%–0.8% by weight |
| Cationic fabric softener | 6%–8% by weight |
| Talc | 0.7%–1.3% by weight |
| Water and inert ingredients | balance to make 100% |

The preferred anionic detergents which are useful in this modification are the sulfate and sulfonate detergents having a substantially linear alkyl group of about 11 to 12 carbon atoms, if aliphatic, or from about 11 to 15 carbon atoms (in the alkyl group), if of the alkylaryl type. A number of representative compounds are discussed above.

The alkaline builders have also been described above. In connection with the use of builders, it will be noticed that higher than normal amounts are used, which together with talc, aid in making the resulting detergent a dry, free-flowing powder. The soil suspending and anti-redeposition agents are those well known in the art, i.e. sodium carboxymethyl cellulose, hydroxy ethyl cellulose, etc., and alkali metal silicates.

In addition to the above, the compositions may also contain minor amounts of the benzene sulfonates or the lower alkyl benzene sulfonates to aid in processing. Water and inert fillers, i.e. sodium sulfate, will also be present in most compositions.

A typical formulation is the following:

| | |
|---|---|
| Linear alkyl benzene sulfonate having 11-15 carbon atoms in the alkyl group | 8.0%-10.5% by weight |
| Phosphate builders | 55%-65% by weight |
| Carboxy methyl cellulose or hydroxy ethyl cellulose | 0.5%-0.8% by weight |
| Alkali metal silicate | 4%-6% by weight |
| Alkali metal benzene sulfonate, toluene sulfonate, xylene sulfonate or cumene sulfonate | 1%-3% by weight |
| Talc | 0.7%-1.3% by weight |
| Distearyl dimethyl ammonium chlorides | 6%-8% by weight |
| Sodium sulfate and inert impurities | 10%-14% by weight |
| Water | balance to make 100% |

Reverting to the preferred embodiment characterized by the blending of two or more powders, as already mentioned, the anionic detergent phase with which the cationic phase is mixed may contain, in addition to the essential active ingredients, namely, synthetic organic, anionic detergent and a builder, a variety of other materials to improve various properties of the detergent. Typically, an appropriate formulation for use as the detergent phase in the above-described multi-functional detergent formulation will contain the following ingredients (weight percentages are given based on the weight of the detergent phase):

| | |
|---|---|
| Anionic detergent | 9%-25% |
| Alkaline phosphate builder | 38%-70% |
| Cellulosic soil anti-redeposition agent | 0.2%-0.8% |
| Amide suds improver | 0%-6% |
| Sodium silicate ($SiO_2/NaO_2$ ratio 2.4:1) | 0%-8% |
| Aryl or short chain alkylaryl sulfonate powder conditioner | 0%-8% |
| Water | 6%-24% |
| Inert salts, colorants, dyes, optical brighteners, germicides, etc. | balance to make 100% |

A preferred composition for use as the detergent phase in the present invention is as follows:

| | |
|---|---|
| Anionic detergent | 9% to 16% |
| Phosphate builder | 50% to 60% |
| Carboxyalkyl cellulose ether, hydroxyalkyl cellulose ether, or carboxyalkyl hydroxyalkyl cellulose ether | 0.35% to 0.55% |
| Alkylolamide suds booster | 2% to 4% |
| Sodium silicate | 3% to 5.5% |
| Alkali metal toluene sulfonate or xylene sulfonate | 0.5% to 1.6% |
| Water | 11% to 20% |
| Inert salts, colorants, dyes optical brighteners, germicides, perfumes | Balance to make 100% |

As already mentioned, the organic detergents which may be used are the sulfuric acid derivatives of alkyl or alkyl-aryl hydrocarbons containing from about 8 to 22 carbon atoms. Of the older established detergents, sodium or potassium polypropylene benzene sulfonates are by far the most widely used materials for laundry compositions. Other detergents which have found popularity include the tallow alcohol sulfates, the acyl-N-methyl taurines, the acyl isethionates, and the alkyl glycerol sulfates. More recently, as is well known, considerable emphasis has been placed upon the use of biodegradable detergent compositions. Linear alkyl benzene sulfonates are among those detergents which appear to be satisfactory for this purpose.

The phosphate builders mentioned above may be any of the well known alkaline phosphate salts. The most commonly employed salts are the sodium or potassium pyrophosphates and polyphosphates. Other materials which may be used include trisodium phosphate and sodium hexametaphosphate.

In the present invention it has been found that the presence of a cationic fabric softening compound which is believed to be present in water as the cationic-anionic complex, in the multi-functional detergents tends to suppress the suds level obtained. If a low sudsing detergent is desired, having a suds volume equivalent to those detergents now commercially marketed as "low sudsing", the presence of a suds booster is not normally needed. On the other hand, if a high sudsing detergent is desired, to compete with the so-called "high sudsing" materials of commerce, it will normally be appropriate to provide for the presence of a suds booster. The alkanamides and alkanolamides have been found particularly useful for this purpose. Coconut monoethanolamide, coconut diethanolamide, and lauric isopropanolamide are among those materials which have found widespread commercial acceptance.

In some instances, it might be desired to prepare a multi-functional detergent composition having sanitizing action. For instance, materials marketed as diaper washing compositions will normally have germicidal ingredients added. Typical germicides are the halogenated salicylanilides. Other materials which have been suggested include halogenated carbanilides, phenyl mercuric salts, and hexachlorophene. The amount of germicide required to obtain effective sanitizing action will depend to some extent upon the potency of the germicidal ingredient which is employed. For those germicides commonly employed in detergent materials, a concentration in the order of 0.2% to 1% may be employed, although germicides of high potency may be used in very much lower concentrations. When germicides are employed, the presence of talc in the formulation is desirable because talc appears to potentiate the effectiveness of the germicides.

As mentioned, certain of the ingredients in the detergent phase composition have been found, surprisingly, to affect the ability of the multi-functional composition to provide softness as well as detergency. Reference in this connection is made specifically to the sodium silicate and to sodium toluene sulfonate or sodium xylene sulfonate. Because both of these materials have been found to improve the ability of the fabric softening agent to impart softness to the washed clothing, in the preferred compositions both of these materials will be present although, as will be recognized, neither is necessary to give the detergent portion of the formulation its essential detergency characteristics.

For a further understanding of the present invention, reference may be had to the following examples:

EXAMPLE 1

A composition suitable for use as the fabric-softening phase of a multi-functional detergent composition was prepared having the following composition:

| Components | Percentages |
|---|---|
| Distearyl dimethyl ammonium chloride | 77.5 |
| Alfonic 1620-7[1] | 9.7 |
| Talc | 12.9 |

[1]Alfonic 1620-7 is a condensate of an alkyl alcohol containing between about 16 and 20 carbon atoms with ethylene oxide. The alcohol is linear, and is prepared by the Ziegler polymerization of ethylene. The ethylene oxide condensate contains approximately 67.2% ethylene oxide.

The foregoing ingredients were prepared into a dry powder by co-melting the distearyl dimethyl ammonium chloride and Alfonic 1620-7. Talc was blended into the melt, and the melt solidified. The solidified composition was pulverized to prepare the desired powder.

EXAMPLE 2

A composition for use as the detergent phase was prepared having the following ingredients:

| Components | Percentages |
|---|---|
| Alkyl aryl sulfonate[2] | 13.0 |
| Sodium tripolyphosphate | 54.2 |
| Sodium carboxymethyl cellulose | .49 |
| Coconut monoethanolamide | 2.71 |
| Sodium sulfate | 8.02 |
| Sodium toluene sulfonate | 1.08 |
| Sodium silicate | 4.33 |
| Fluorescent Dye | 0.43 |
| Polybromosalicylanilide germicide[3] | 0.54 |
| Water | 15.14 |

[2]A linear sodium alkyl benzene sulfonate containing $C_{13}$–$C_{16}$ alkyl groups.
[3]A mixture of 4',5 dibromo and 3,4',5 tribromosalicylanilide.

The foregoing detergent phase was prepared as a spray-dried powder, and dry blended with the composition described in Example 1. 92.25 parts by weight of detergent phase was used for each 7.75 parts by weight of the composition of Example 1. The resultant composition thereby contained 2 parts by weight of anionic detergent sulfonate for each part of cationic fabric softener compound. The mixture imparted marked softness to clothing washed therewith, so that rinse-cycle softeners were not required. Detergency was also excellent. Fabric yellowing and spotting were notably absent.

The present invention is further illustrated by the following examples in which the procedure generally described in Examples 1 and 2 was repeated with other materials and with varying proportions thereof.

TABLE 1

| | | Example No. | | | | | | | |
|---|---|---|---|---|---|---|---|---|---|
| Detergent phase | Notes | 3 | 4 | 5 | 6 | 7 | 8 | 9 | 10 |
| Na alkyl sulfate | 1 | 8 | | | | | | | |
| Na alkylbenzene sulfonate | 2 | | 23 | 12 | | 14 | 12 | | |
| Na lauryl glyceryl ether sulfonate | 3 | | | | 10 | | | | |
| Na acyl taurate | 4 | | | | | | | 20 | |
| Na dodecanesulfonate | | | | | | | | | 20 |
| Coco monoethanolamide | 5 | 2 | 3 | 2.5 | 2 | 3 | 2.5 | | |
| Coco monoethanolamide 2 E.O. | 6 | | | | | | | | 3 |
| Pentasodium tripolyphosphate | | 35 | | 50 | | 50 | 45 | | |
| Tetrasodium pyrophosphate | | 30 | | | | | | | |
| Tetrapotassium pyrophosphate | | | 53 | | | | | | |
| Hexasodium tetraphosphate | 7 | | | | 45 | | | | |
| Na hexametaphosphate | | | | | | | | | 35 |
| Sodium carboxymethyl cellulose | | | | 0.5 | 0.5 | | 0.4 | | |
| Sodium carboxymethyl hydroxyethyl cellulose | | | 0.6 | | | 0.5 | | | |
| Hydroxyethyl cellulose | | | | | | | | 0.5 | 0.5 |
| Sodium toluene sulfonate | | 8 | | 1 | 6 | 2 | 0.5 | | |
| Sodium benzene sulfonate | | | | | | | | 3 | 3 |
| Potassium benzene sulfonate | | | 6 | | 2 | | | | |
| Sodium silicate 2.4:1 | | | 3 | 4 | 5 | 4 | 4 | | |
| Sodium silicate 1:1 | | | | | | | | 4 | 3 |
| Sodium sulfate | | 4.00 | 0.4 | 15.3 | | 2.7 | 16.3 | 60.0 | 13.0 |
| Water | | 7 | 3 | 6.5 | 9.5 | 14 | 10 | 6 | 8 |
| Fluorescent Dye | 8 | | | 0.2 | | 0.2 | 0.5 | | |
| Fluorescent Dye | 9 | | | 0.2 | | 0.2 | 0.5 | | |
| Germicide | 10 | | | | | | 0.5 | | |
| Germicide | 11 | | | | | | | 0.5 | |
| Total Detergent Phase | | 94.0 | 92.0 | 92.2 | 80.0 | 90.6 | 92.2 | 94.0 | 85.5 |
| Culversoft S-75 | 12 | | 7 | | | | | | |
| Adogen 442 | 13 | 5.5 | | 6 | 10 | 6 | 6 | 5 | 12.5 |
| Alfonic 1620-7 | 14 | 0.5 | | 0.8 | 1.0 | 1.2 | 0.8 | | |
| Sterox AJ-100 | 15 | | 1 | | | | | | |
| Stearyl alcohol 24 E.O | 16 | | | | | | | | 2.0 |
| Lauryl alcohol 4 E.O | 17 | | | | | | | 1 | |
| Talc | 18 | | | 1 | 9 | | 1 | | |
| Polyethylene powder | 19 | | | | | 1 | | | |

TABLE 1-continued

| Detergent phase | Notes | Example No. 3 | 4 | 5 | 6 | 7 | 8 | 9 | 10 |
|---|---|---|---|---|---|---|---|---|---|
| Total Softener Phase | | 6.0 | 8 | 7.8 | 20.0 | 9.4 | 7.8 | 6.0 | 14.5 |

The compositions outlined above are prepared as illustrated already in Examples 1 and 2. Excellent results are obtained.

[1]The sodium salt of sulfated alcohols derived from coconut oil.

[2]The sodium salt of a sulfonated mixture of monophenyl straight-chain alkanes in which the phenyl group is randomly attached to the alkyl chain. The alkyl portion of the mixture is composed of the following chain lengths: 0.1% $C_{10}$, 5–10% $C_{11}$, 25–40% $C_{12}$, 25–50% $C_{13}$, 10–30% $C_{14}$, 0–1% $C_{15}$. The isomeric distrubition is as follows: 15–30% 2-phenyl, 15–25% 3-phenyl, 15–25% 4-phenyl, 15–25% 5-phenyl, 15–25% 6- and 7-phenyl.

[3]The sodium salt of 3-alkoxy-2-hydroxy-propane sulfonate wherein the alkoxy groups are formed from mixed alcohols of chain lengths characteristic of alcohols derived from coconut oil.

[4]An Igepon T prepared by reacting the sodium salt of taurine with a mixture of fatty acids derived from coconut oil.

[5]N-2-hydroxyethyl alkanamide derived from coconut oil.

[6]Prepared by reacting an average of 2 molar proportions of ethylene oxide with coco monoethanolamide.

[7]$Na_6P_4O_{13}$

[8]Tinopal RBS, a brightening agent having the formula:

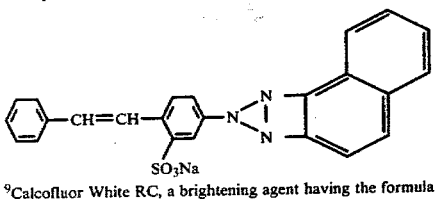

[9]Calcofluor White RC, a brightening agent having the formula

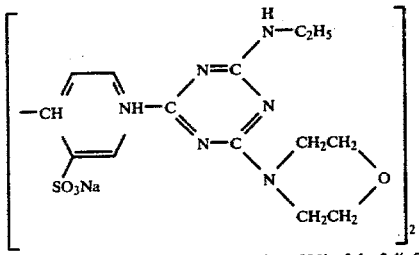

[10]Tribromosalicylanilide. Contains at least 90% of the 3.4', 5-deritive, and less than 2% of the 4', 5-derivative.

[11]A mixture of brominated salicylanilides, mainly equal parts of the 3,4', 5- and 4', 5-derivatives.

[12]Culversoft S-75 is 1-methyl-1-alkylamido-ethyl-2-alkyl imidazolinium methosulfate.

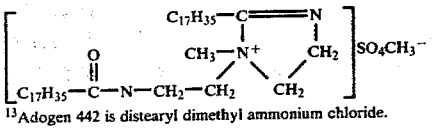

[13]Adogen 442 is distearyl dimethyl ammonium chloride.

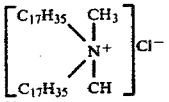

[14]A nonionic surfactant which is a mixture of long-chain alcohol-ethylene oxide condensates. The alcohol portion is a mixture of about 50% $C_{16}$, 33% $C_{18}$, 12% $C_{20}$, and not over 6% total $C_{10}$, $C_{12}$, $C_{14}$ and $C_{22}$ chain lengths. The ethoxylated product contains about 67.5% ethylene oxide, whole molecule basis.

[15]A nonionic surfactant which is a condensate of an average $C_{13}$ Oxo alcohol and an average of about 10 molar proportions of ethylene oxide. The ethoxylated product contains about 73% ethylene oxide, whole molecule basis.

[16]A nonionic surfactant which is a condensate of octadecanol and 24 molar proportions of ethylene oxide. This condensate contains about 80% ethylene oxide, whole molecule basis.

[17]A nonionic surfactant which is a condensate of a mixture of fatty alcohols derived from coconut oil, and 4 molar proportions of ethylene oxide. This condensate contains about 49% ethylene oxide.

[18]Particle size of talc used:

| | Percent |
|---|---|
| Less than 44 microns | 99.9 |
| Less than 40 microns | 99.8 |
| Less than 30 microns | 99.0 |
| Less than 20 microns | 92.0 |
| Less than 15 microns | 88.0 |
| Less than 10 microns | 56.0 |
| Less than 5 microns | 27.0 |
| Less than 4 microns | 22.0 |
| Less than 3 microns | 11.0 |
| Less than 2 microns | 9.0 |
| Less than 1 micron | 5.0 (est.) |

[19]Polyethylene powder having the following particle size distribution:

| | |
|---|---|
| 28% below | 5 microns |
| 37% between | 5–10 microns |
| 22% between | 10–15 microns |
| 9% between | 15–20 microns |
| 4% above | 20 microns |

EXAMPLE 11

A wash cycle softener embodying the present invention has the following composition:

| | |
|---|---|
| Sodium 2-hydroxytetradecyl sulfate | 7.0% by weight |
| Nopcosoft CP 100, 100% active[1] | 30.0% |
| Stearyl alcohol . 24 E.O. | 3% |
| Sodium sulfate | 60% |

[1] 1-ethyl-1-heptadecyl amido ethyl-2-heptadecyl imidazolinium ethosulfate

We claim:

1. A multi-functional detergent composition consisting essentially of (1) a cationic nitrogenous compound having from 15 to 65 carbon atoms in its molecule and having at least one cationic nitrogen atom, said cationic nitrogenous compound being selected from the group consisting of:

(i) the reaction product of higher fatty acids with hydroxy alkyl alkylene diamines in a molecular raio of about 2:1, said reaction product containing a composition having a compound of the formula

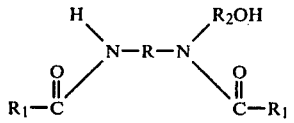

wherein R is a $C_1$–$C_3$ alkylene radical, $R_1$ is a $C_{15}$ to $C_{19}$ acyclic aliphatic hydrocarbon radical and $R_2$ is a divalent $C_1$–$C_3$ alkylene radical;

(ii) quaternary ammonium compounds having the formula

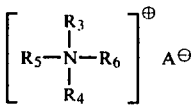

wherein $R_3$ is a $C_{16}$–$C_{20}$ acyclic, aliphatic hydrocarbon group, $R_4$ and $R_5$ are selected from the group consisting of $R_3$ and $C_1$–$C_3$ alkyl groups, $R_6$ is a $C_1$–$C_3$ alkyl group or a benzyl group and $A^\ominus$ is an anion imparting water dispersibility;

(iii) alkanamide alkylene pyridinium chloride having the formula

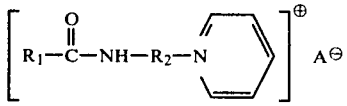

wherein $R_1$ is a $C_{15}$–$C_{19}$ acyclic, aliphatic hydrocarbon radical and $R_2$ is a divalent $C_1$–$C_3$ alkylene radical, and A is a chlorine atom;

(iv) 1-(2-alkylamido ethyl)-2-alkyl imidazoline salts having the formula

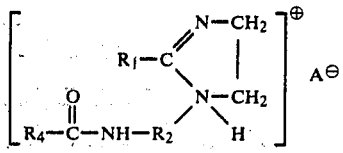

wherein $R_1$, $R_2$ and $R_4$ are as defined above and $A^\ominus$ is an anion imparting water dispersibility;

(v) the salts of heptadecyl imidazoline having the formula

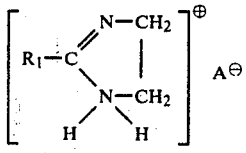

wherein $R_1$ is a heptadecyl radical and $A^\ominus$ is an anion which imparts water dispersibility;

(vi) quaternary benzyl amines of the formula

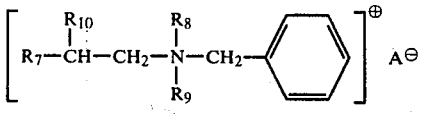

wherein $R_7$ is an alkyl group having 7 to 12 carbon atoms, $R_8$ and $R_9$ are independent alkyl groups of 1 to 3 carbon atoms or hydroxyalkyl groups of 2 to 3 carbon atoms, $R_{10}$ is hydrogen or a hydroxyl group $A^\ominus$ is an anion imparting water dispersibility;

(vii) compounds of the formula

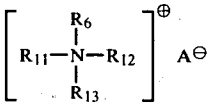

wherein $R_8$ and $A^\ominus$ are as defined above, $R_{11}$ is an alkyl group having 12 to 14 carbon atoms, $R_{12}$ is selected from the group consisting of $R_8$ and $R_{11}$, and $R_{13}$ is selected from the group consisting of $R_8$ and benzyl;

(viii) compounds of the formula

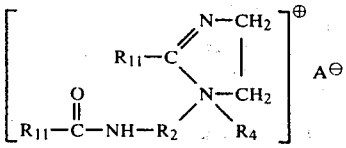

wherein $R_2$ is a divalent alkylene group having 1 to 3 carbon atoms, $R_4$ is an alkyl group having 1 to 3 carbon atoms, and $R_{11}$ and A are defined above;

(ix) compounds of the formula

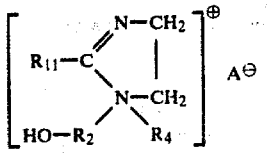

wherein $R_2$, $R_4$, $R_{11}$ and A are as defined above; and (x) compounds of the formula

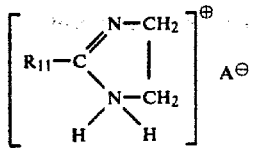

(2) an anionic organic detergent compound selected from the group consisting of the water soluble organic sulfate and sulfonate salts having a hydrocarbon group of 8 to 22 carbon atoms, said cationic nitrogeneous compound and anionic detergent being so selected that when combined in a 1:1 mole ratio in a cationic-anionic complex the complex will have a total of 2 to 4 long-chain alkyl groups of 12 to 24 carbon atoms and a total of at least 29 carbon atoms, the molar ratio of said anionic detergent compound to said cationic nitrogenous compound being between ½:1 and 12:1, and (3) a nonionic dispersant which is an alkyl alcohol-ethylene oxide condensate having 12–22 carbon atoms in the alkyl group containing from 60% to 75% ethylene oxide, there being for each 100 parts of said cationic nitrogenous compound from 9 to 20 parts of said nonionic dispersant, said dispersant further being present in an amount less than 10% by weight of the cationic nitrogenous compound and the anionic organic detergent, wherein said multifunctional detergent composition further contains (a) between 8% and 22% by weight of said anionic detergent compound (2);

(b) from 35% to 65% by weight of a builder effective to improve the detergent properties of said anionic organic detergent;

(c) from 1% to 7.5% sodium silicate; and (d) from 0.5% to 7.5% of sodium xylene sulfonate or sodium toluene sulfonate.

2. A multi-functional detergent composition according to claim 1, having blended therein up to 160 parts of a fabric softening improving agent selected from the group consisting of talc, finely-divided powders of polyethylene, polypropylene, poly(tetrafluorethylene), polyethylene glycols having a molecular weight of 20,000 or more, calcium and magnesium stearate, for each 100 parts of said cationic nitrogenous compound.

3. A multifunctional detergent composition consisting essentially of a dry blend of (a) a pulverulent composition, each individual particle of which is an intimate admixture consisting essentially of

| | |
|---|---|
| an organic compound having detergent properties selected from the group consisting of alkyl sulfates and alkylaryl and alkane sulfonates containing from 8 to 22 carbon atoms | 9 to 25% |
| an organic phosphate builder | 38 to 70% |
| a soil redeposition agent selected from the group consisting of alkali metal, carboxyalkyl cellulose and hydroxyalkyl cellulose | 0.2 to 0.8% |
| an amide-type improver | 0 to 6% |
| sodium silicate | 0 to 8% |
| a compound selected from the group consisting of sodium toluene sulfonate and sodium xylene sulfonate | 0 to 8% |
| water | 6 to 24% |
| inert salts, colorants, dyes, optical brighteners, germicides and perfumes | balance to make 100% |

and (b) a pulverulent composition, each individual particle of which is an intimate admixture of (1) a cationic nitrogenous compound having from 15 to 65 carbon atoms in its molecule and having at least one cationic nitrogen atom, said cationic nitrogenous compound being selected from the group consisting of:

(i) the reaction product of higher fatty acids with hydroxy alkyl alkylene diamines in a molecular ratio of about 2:1, said reaction product containing a composition having a compound of the formula

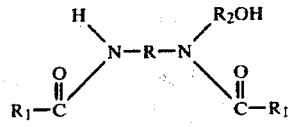

wherein R is a $C_1$–$C_3$ alkylene radical, $R_1$ is a $C_{15}$ to $C_{19}$ acyclic aliphatic hydrocarbon radical and $R_2$ is a divalent $C_1$–$C_3$ alkylene radical;

(ii) quaternary ammonium compounds having the formula

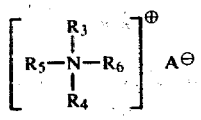

wherein $R_3$ is a $C_{16}$–$C_{20}$ acyclic, aliphatic hydrocarbon group, $R_4$ and $R_5$ are selected from the group consisting of $R_3$ and $C_1$–$C_3$ alkyl groups, $R_6$ is a $C_1$–$C_3$ alkyl group or a benzyl group and A⊖ is an anion imparting water dispersibility;

(iii) alkanamide alkylene pyridinium chloride having the formula

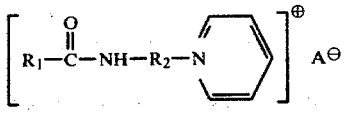

wherein $R_1$ is a $C_{15}$–$C_{19}$ acyclic, aliphatic hydrocarbon radical and $R_2$ is a divalent $C_1$–$C_3$ alkylene radical, and A is a chlorine atom;

(iv) 1-(2-alkylamido ethyl)-2-alkyl imidazoline salts having the formula

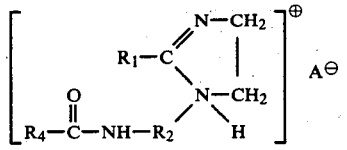

wherein $R_1$, $R_2$ and $R_4$ are as defined above and $A^{\ominus}$ is an anion imparting water dispersibility;

(v) the salts of heptadecyl imidazoline having the formula

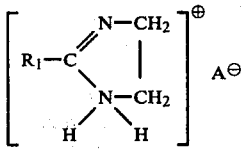

wherein $R_1$ is a heptadecyl radical and $A^{\ominus}$ is an anion which imparts water dispersibility;

(vi) quaternary benzyl amines of the formula

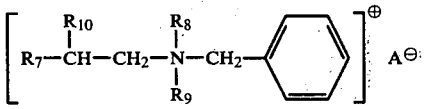

wherein $R_7$ is an alkyl group having 7 to 12 carbon atoms, $R_8$ and $R_9$ are independent alkyl groups of 1 to 3 carbon atoms or hydroxyalkyl groups of 2 to 3 carbon atoms, $R_{10}$ is hydrogen or a hydroxyl group and $A^{\ominus}$ is an anion imparting water dispersibility;

(vii) compounds of the formula

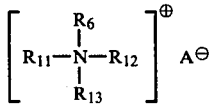

wherein $R_8$ and $A^{\ominus}$ are as defined above, $R_{11}$ is an alkyl group having 12 to 14 carbon atoms, $R_{12}$ is selected from the group consisting of $R_8$ and $R_{11}$, and $R_{13}$ is selected from the group consisting of $R_8$ and benzyl;

(viii) compounds of the formula

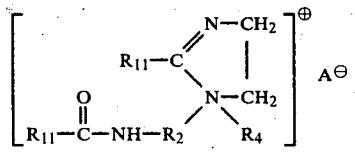

wherein $R_2$ is a divalent alkylene group having 1 to 3 carbon atoms, $R_4$ is an alkyl group having 1 to 3 carbon atoms, and $R_{11}$ and A are as defined above;

(ix) compounds of the formula

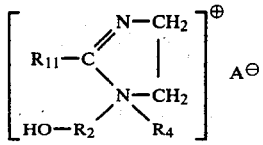

wherein $R_2$, $R_4$, $R_{11}$ and A are as defined above; and (x) compounds of the formula

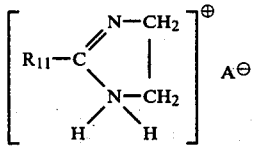

and (2) a nonionic dispersant which is an alkyl alcohol ethylene oxide condensate having 12–22 carbon atoms in the alkyl group and containing from 60% to 75% ethylene oxide, there being for each 100 parts of said cationic nitrogenous compound from 9 to 20 parts of said nonionic dispersant, wherein the proportion of said composition (A) to said composition (B) is such that the molar ratio of such organic compound having detergent properties to said cationic nitrogenous compound is between ½:1 and 12:1, and the amount of said nonionic dispersant present is less than 10% by weight of the cationic nitrogenous compound and the anionic organic detergent.

4. A multifunctional detergent composition according to claim 3 wherein said composition (A) consists essentially of

| | |
|---|---|
| an organic compound having detergent properties selected from the group consisting of alkyl sulfates and alkylaryl and alkane sulfonates having from 8 to 22 carbon atoms | 9 to 16% |
| an alkaline builder selected from the group consisting of alkali metal tripolyphosphate and alkali metal pyrophosphate | 50 to 60% |
| a soil redeposition agent selected from the group consisting of alkali metal carboxyalkyl cellulose ethers and hydroxyalkyl cellulose ethers | 0.35 to 0.55% |
| a suds-boosting agent selected from the group consisting of alkanamides and alkanolamides | 2.0 to 4% |
| sodium silicate | 3 to 5.5% |
| a compound selected from the group consisting of sodium toluene sulfonate and sodium xylene sulfonate | 0.5 to 1.6% |
| water | 11% to 20% |
| inert salts, colorants, dyes, optical brightners, germicides and perfumes | balance to make 100% |

* * * * *

UNITED STATES PATENT AND TRADEMARK OFFICE

CERTIFICATE OF CORRECTION

PATENT NO. : 4,255,294

DATED : March 10, 1981

INVENTOR(S) : Rudy, et al.

It is certified that error appears in the above—identified patent and that said Letters Patent is hereby corrected as shown below:

First page, 2nd col. 5th line, "3,095,323" should read--3,095,373--;

Col. 2, line 53, after "ratios)" insert a comma (--,--);

Col. 5, line 59, "$R_6$" should read --$R_8$--;

Col. 12, line 21, "monogeneous" should read --homogeneous--;

Col. 13, line 4, "11 to 12" should read --11 to 18--;

Col. 17, Footnote 10, "3,4'5-deritive" should read --3,4'5-derivative--;

Col. 20, line 42, "$R_6$" should read --$R_8$--;

Col. 22, line 9, before "improver" insert--suds--;

Col. 23, line 41, "$R_6$" should read --$R_8$--;

Signed and Sealed this

*Seventh* Day of *July 1981*

[SEAL]

*Attest:*

RENE D. TEGTMEYER

*Attesting Officer*

*Acting Commissioner of Patents and Trademarks*